United States Patent [19]

Ehrman et al.

[11] 4,440,302

[45] Apr. 3, 1984

[54] NESTABLE AND STACKABLE BASKET ASSEMBLY

[75] Inventors: Charles R. Ehrman, Memphis, Tenn.; Ronald W. Killgo, Athens, Tex.; Paul P. Piper, Jr., Memphis, Tenn.

[73] Assignee: Piper Industries, Inc., Memphis, Tenn.

[21] Appl. No.: 322,655

[22] Filed: Nov. 18, 1981

[51] Int. Cl.[3] ..... B65D 21/06

[52] U.S. Cl. ..... 206/506; 206/507

[58] Field of Search ..... 206/505, 506, 507

[56] References Cited

U.S. PATENT DOCUMENTS

| | | | |
|---|---|---|---|
| Re. 26,350 | 2/1968 | Wilson . | |
| 3,027,045 | 3/1965 | Wilson | 206/505 |
| 3,379,339 | 4/1968 | Asenbauer | 206/506 |
| 3,404,804 | 10/1968 | Frater et al. . | |
| 3,669,300 | 6/1972 | Thomas | 220/20.5 |
| 3,934,724 | 1/1976 | Johnson . | |
| 4,000,817 | 1/1977 | Sanders et al. . | |
| 4,109,791 | 8/1978 | Clipson et al. . | |

FOREIGN PATENT DOCUMENTS

| | | | |
|---|---|---|---|
| 2007788 | 8/1971 | Fed. Rep. of Germany . | |
| 1214271 | 2/1970 | United Kingdom | 206/507 |
| 1383917 | 2/1975 | United Kingdom | 206/505 |

*Primary Examiner*—George E. Lowrance

*Attorney, Agent, or Firm*—King and Liles

[57] ABSTRACT

A nestable and stackable basket assembly for shipping or displaying bakery products includes a bottom wall, side walls and end walls. Stacking towers, including stepped slots formed in the end walls, project inwardly to define nesting stop surfaces at different and corresponding heights on the upper end thereof. A pair of movable lugs with upwardly facing support surfaces are provided on each end wall and are adjustable for selective engagement with corresponding stop surfaces. The lugs project inwardly from the end wall and are interconnected with a rack and pinion arrangement for equal and opposite sliding movement when one of the lugs is manually indexed. The lugs may be manually indexed along the end walls to achieve (1) a full nesting position, (2) two intermediate stacking positions, and (3) a full stacking position; all with the baskets being in a vertical in-line relationship and without end-to-end rotation of the baskets. Vertical offset stacking between like baskets for display purposes is achieved with separate display towers.

21 Claims, 23 Drawing Figures

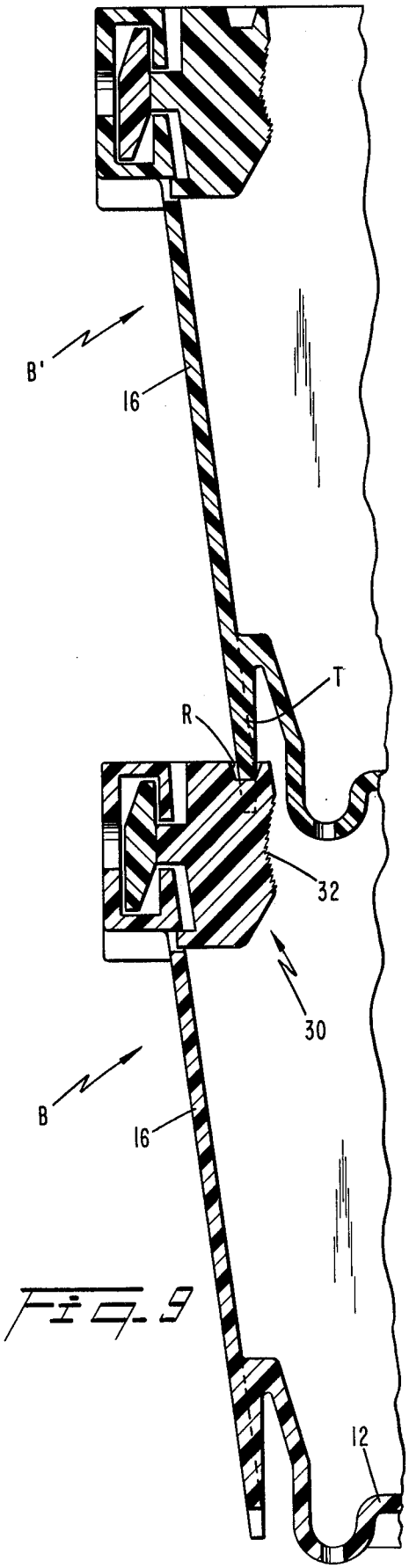
Fig. 9
Fig. 10
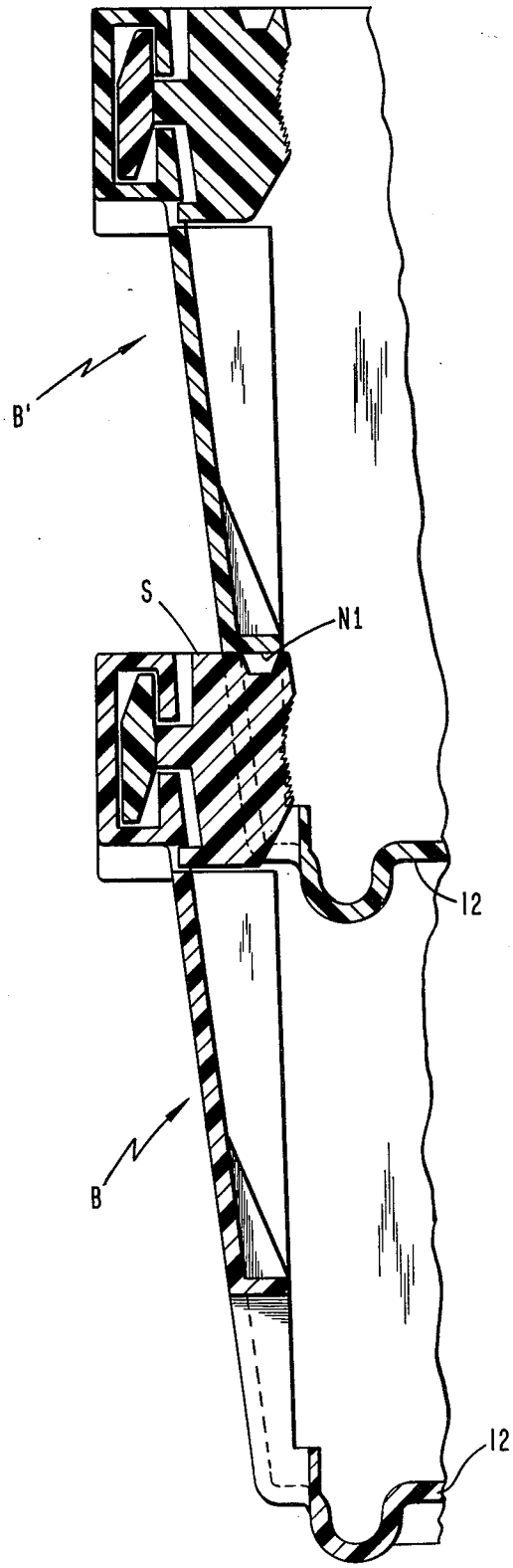

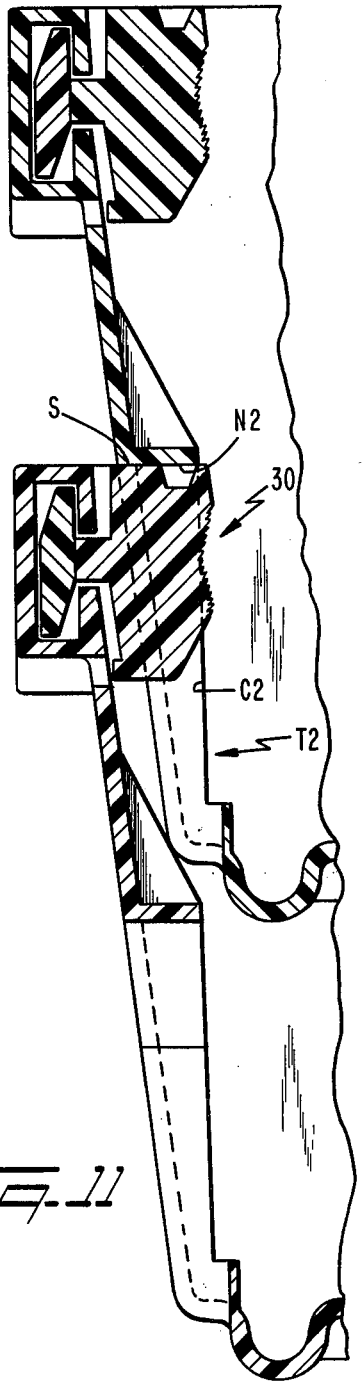
Fig. 11
Fig. 12
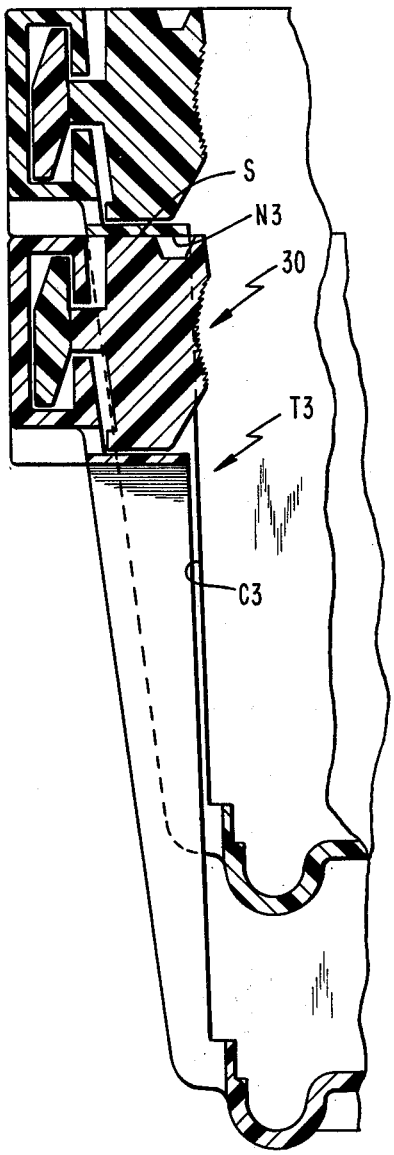

NESTABLE AND STACKABLE BASKET ASSEMBLY

TECHNICAL FIELD

This invention generally relates to nestable and stackable basket assemblies and, more particularly, to a nestable and stackable basket assembly with means for nesting one basket on top of another at four different stacking heights without rotating the upper basket with respect to the lower basket.

BACKGROUND ART

Nestable and stackable baskets are commonly used in the baking industry for transporting bakery products to retail stores. In loading operations, single baskets are filled with identical product, such as bread, cakes or buns. A number of filled baskets are manually and evenly stacked on top of each other by bakery loaders and loaded into trucks.

Since bakery products come in several different thicknesses or heights, it is known in the baking industry to utilize baskets having features enabling stacking on each other at different stacking heights, depending upon the profile of products in each basket. This protects the contents and reduces shipping costs.

These multi-level stacking baskets are of generally rectangular configuration and typically include end walls and side walls formed with stacking saddles and stacking feet. Nesting stop surfaces are formed in the saddles at different heights to receive corresponding stacking support surfaces on the stacking feet. Vertical in-line nesting of two baskets at a particular height is achieved by placing one basket on another basket so the upwardly facing support surfaces of the lower basket engage the downwardly facing stop surfaces of the upper basket.

A frequently recurring problem with such baskets is that different orientation of one basket with respect to another basket is often required to vary the stacking height, resulting in increased handling of the baskets and greater shipping costs. Also, during manual handling, the bakery loader may misorient the basket being stacked, resulting in an unstable stacked structure that can easily topple, or result in crushed bakery goods.

Since bakery goods are staple products that are rapidly sold, it is often undesirable to manually unload the contents of each basket onto store shelves after delivery. Unfortunately, commercially available baskets usually do not include features enabling stacking in vertically offset relation for display and sale purposes.

DISCLOSURE OF INVENTION

It is accordingly an object of the present invention to provide a nestable and stackable basket assembly capable of nesting at adjustable heights in stacked relationship without requiring different orientation between adjacent, nested baskets.

Another object of the invention is to provide a nestable and stackable basket assembly with means enabling a bakery loader to easily set the stacking height during routine handling of the baskets.

A further object of the invention is to provide a nestable and stackable basket assembly with means to achieve positive stacking in every stacked position.

Another object is to provide a basket assembly capable of securely stacking in a vertically offset position in the full stacking height for display of the product.

Still a further object is to provide a basket assembly capable of achieving full nesting and full height stacking positions and two intermediate stacking positions to accommodate a large variety of bakery products, as well as allow for efficient return shipment of empty baskets.

Yet another object is to provide a basket assembly that includes adjustable means for providing multiple height stacking and preventing tipping of the baskets when stacked in all positions including at the full height position.

Additional objects, advantages and novel features of the invention will be set forth in detail in part in the description which followed and in part will become apparent to those skilled in the art upon examination of the drawing, or may be learned by practice of the invention. The objects and advantages of the invention may be realized and obtained by means of instrumentalities and combinations particularly pointed out in the appended claims.

The nestable and stackable basket assembly of the present invention is capable of nesting with like basket assemblies at adjustable heights in stacked relationship. The basket assembly includes a bottom wall, end walls and side walls forming a basket body for carrying bakery products and the like. Stacking tower means with stepped, downwardly facing stop surfaces are provided on the opposing pair of end walls. Movable lug means with upwardly facing support surfaces are also provided on the end walls and are adjustable so as to be engageable with the selected stop surfaces.

The stepped tower means are formed by recesses in the end wall open to the inside of the basket. The steps of the tower thus form adjacent slots in the end walls. The upper end of each open tower slot defines the corresponding nesting stop surface.

Preferably, the movable lug means comprise a pair of lugs secured to the upper portion of each of the end walls in sliding engagement therewith. The lugs on each end wall are interconnected with a rack and pinion arrangement for equal and opposite movement when the master lug is manually indexed.

Each lug is fixed to a runner having the positioning rack formed along one edge. The two racks face each other and are drivingly coupled by the idler pinion positioned adjacent the center of the end wall. The one lug of each pair serving as a master lug includes an indentation for thumb engagement. The runner for the master lug serves as a torsion bar allowing pivoting action and release of a lock pin as the thumb engages the lug to commence the adjusting movement. The slave lug follows the movement of the master lug assuring that the two lugs simultaneously engage the corresponding stop surfaces of the stepped towers.

The sides of the lugs and the open tower slots are preferably correspondingly tapered to enable each lug to move into the final supporting engagement with the corresponding stop surfaces as each basket is placed in stacking engagement. This feature assures positive seating of the proper stop surface of the tower with the support surface of the lug. In other words, if the lugs are not in the exact adjusted position, the tapered sides of the tower slots provide the necessary guiding action to insure positive seating.

The lock pin on each master lug engages a detent opening in the end wall when the lug is properly positioned. This assures positive locking action for greater stability in the stack. Also, in the full stack position, the lugs are spread to the outermost position giving maximum stability and prevention against tipping.

BRIEF DESCRIPTION OF DRAWINGS

FIG. 9 is a view taken through the line 9—9 of FIG. 20 showing a pair of basket assemblies in full stack position;

FIG. 10 is a view taken through the line 9—9 of FIG. 21 showing the basket assemblies in a first intermediate or upper nesting position;

FIG. 11 is a view taken through the line 11—11 of FIG. 22 showing the basket assemblies in a second intermediate or lower nesting position;

FIG. 12 is a view taken through the line 12—12 of FIG. 23 showing full nesting engagement between the basket assemblies;

BEST MODE FOR CARRYING OUT THE INVENTION

Referring first to FIGS. 1-4, there is illustrated a nestable and stackable basket assembly B, embodying the principles of the invention. Basket assembly B is used for transporting or displaying baked goods or the like. With the unique features contained within each basket, like basket assemblies can nest or stack in relation to each other at adjustable heights to accommodate different thicknesses of baked goods or the like, with minimum handling effort.

Figure 1:
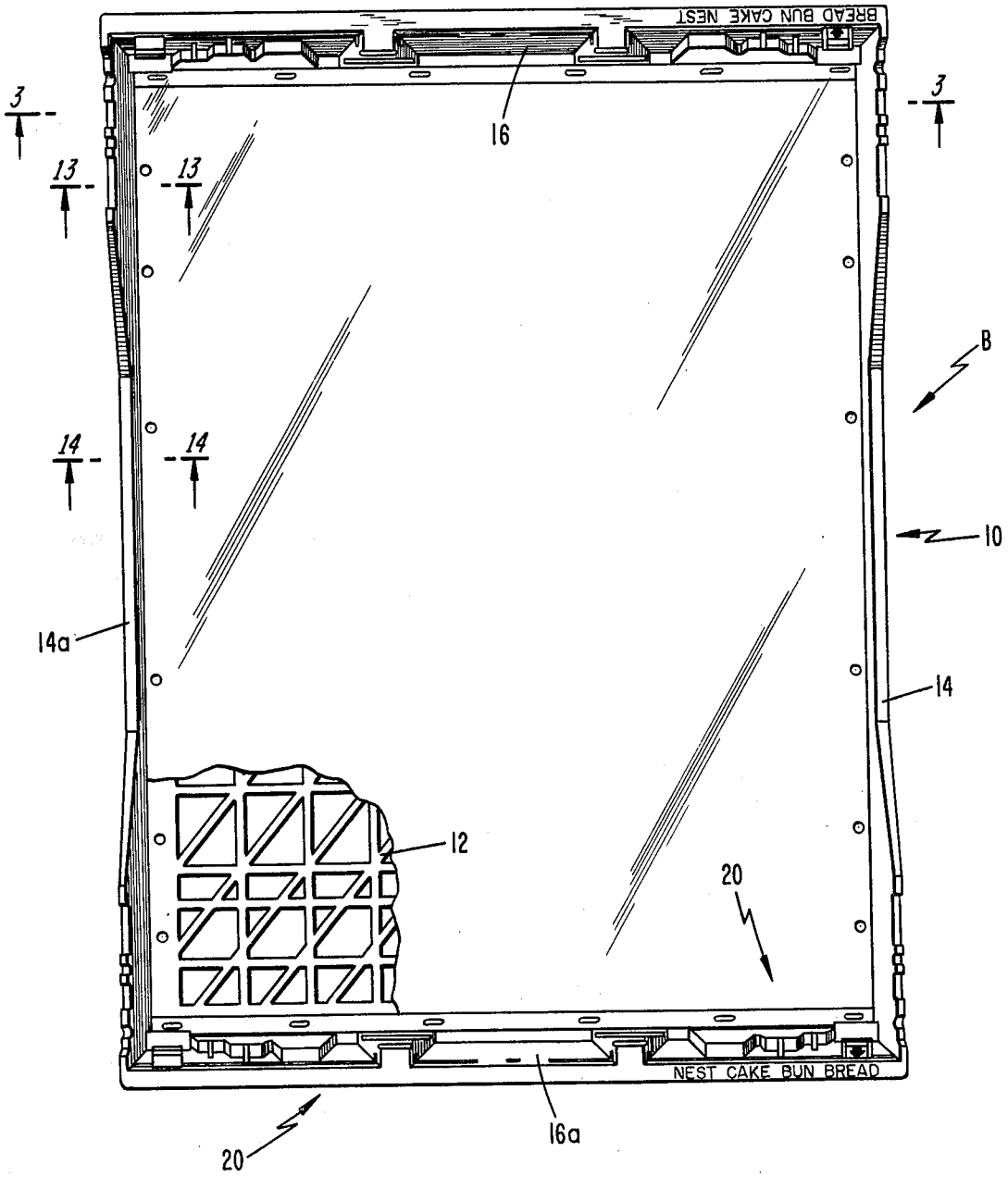
FIG. 1 is a top plan view of the basket assembly of the present invention.

More specifically, basket assembly B includes a basket body 10 having a perforated bottom wall 12 of preferably rectangular configuration, as shown in FIG. 1. A pair of opposing side walls 14, 14*a* and opposing end walls 16, 16*a* integrally joined together, extend upwardly from the bottom wall to form the basket body therewith. The side and end walls are formed outwardly inclined from the bottom wall 12 (see e.g. FIG. 9) to provide for the novel arrangement of stacking features so as to minimize interference with the storage space provided for baked goods in each basket.

Figure 2:
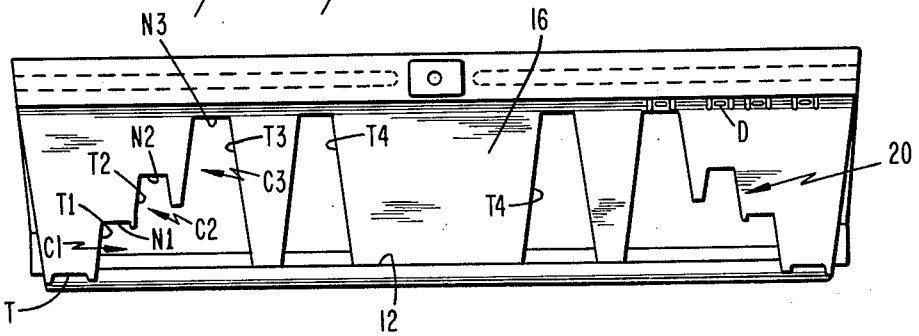
FIG. 2 is an end view of the basket of the invention and showing the stacking towers.

To achieve adjustable nesting of the basket assemblies, stepped tower means, generally designated by reference numeral 20, is integrally formed at opposite ends of each end wall 16 and 16*a*. As shown in FIGS. 1 and 2, each tower means 20 includes three vertical towers T1, T2 and T3 formed at spaced horizontal intervals along each end wall. To provide balanced and stable support for an upper, nested basket B' in nesting engagement with a lower basket B (see e.g. FIG. 10), similar towers (i.e. T1—T1, T2—T2 and T3—T3) are correspondingly located in equispaced relationship from side walls 14, 14*a*.

Towers T1-T3 project inwardly from the end walls 16 and 16*a* to respectively define downwardly facing stop surfaces N1, N2 and N3. Each tower T1-T3 is formed from an inwardly recessed portion of the end wall that is preferably open to the inside of the basket to respectively define open tower slots C1-C3.

Tower slots C1-C3 project upwardly from bottom wall 12. A pair of tapered side flanges 22 project inwardly from the end walls to form the sides of each slot (see FIG. 16). A horizontal top ledge 24 (FIG. 16) interconnects the upper ends of the side flanges 22 to define the upper end of each slot. Side flanges 22 and ledge 24 have approximately the same thickness as end walls 16 and 16*a* to provide a durable tower structure capable of supporting the weight of several nested baskets B' in stacking relationship.

In nesting engagement, the tower slots in an upper basket B' receive support surfaces of lower basket B in supporting engagement (see FIGS. 10-12), as will be seen more fully below.

The underside surface of each ledge 24 respectively defines the downwardly facing nesting stop surface N1-N3. The surfaces N1-N3 also define the upper end of each tower slot C1-C3.

Figure 16:
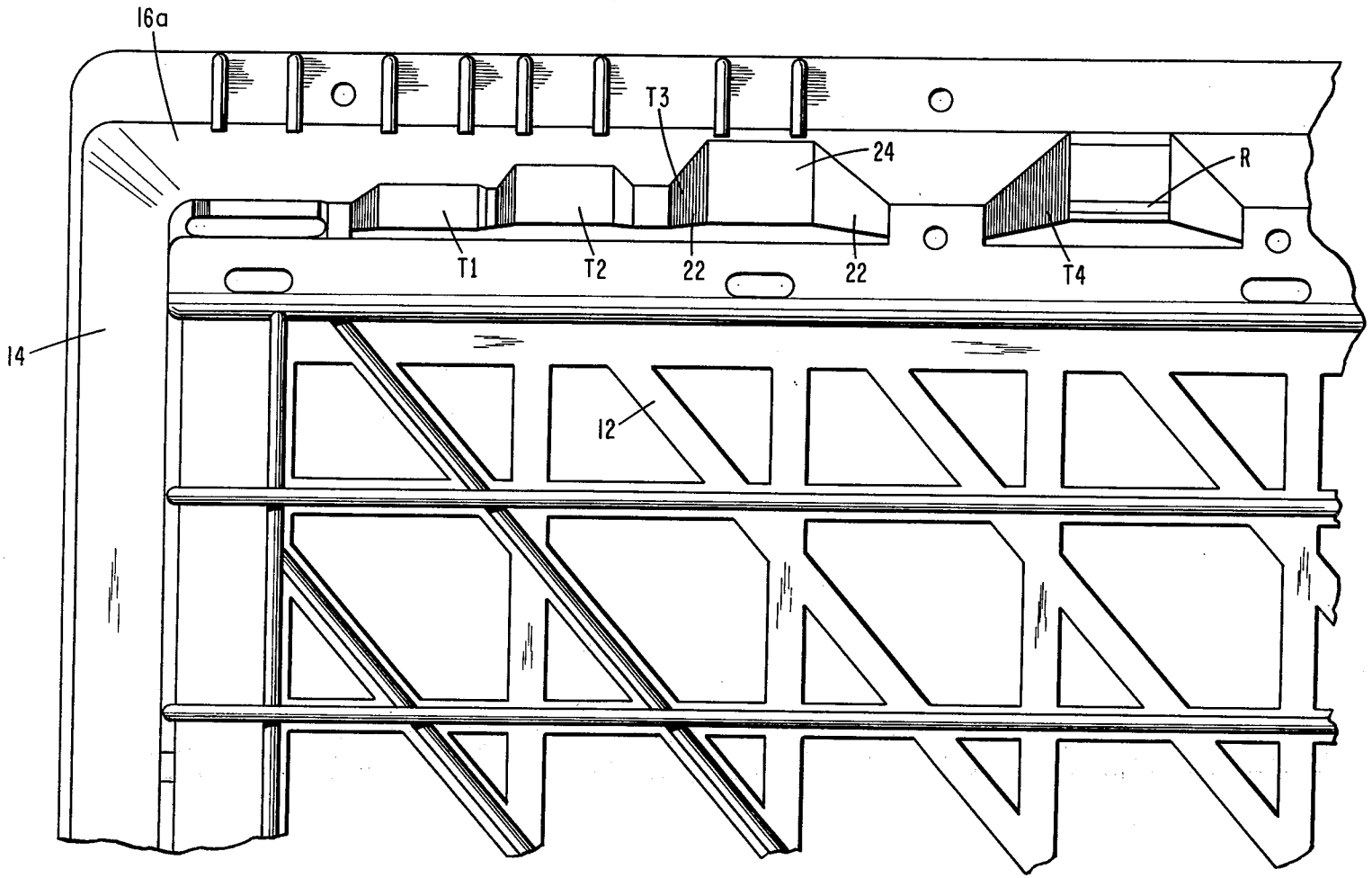
FIG. 16 is a partial top plan view illustrating the design and location of stepped towers and one display tower formed on the end walls.

As best shown in FIGS. 2 and 16, stepped towers T1–T3 are of progressively increasing height in the direction away from side walls 14, 14a. Stop surfaces N1–N3 are thereby correspondingly located at progressively higher positions on the end walls to respectively define a first intermediate or upper nesting position, a second intermediate or lower nesting position and a full nesting (minimal stack) position. The feature of locating stop surfaces N1–N3 on end walls 16, 16a in the aforesaid stepped manner progressively away from the side walls 14, 14a provides for greater horizontal spacing between the stop surfaces when higher stacking positions are utilized between two baskets, for improved stability.

A pair of downwardly extending stacking projections T are formed at the lower, outermost ends of end walls 16, 16a (see FIGS. 2 and 9) immediately adjacent the side walls 14, 14a. Stacking projections T define a high stack position (i.e. minimal nesting position) for basket assemblies B, B'. The lower edge of each projection T defines a nesting stop surface, located slightly below bottom wall 12, as discussed more fully below.

Figure 20:
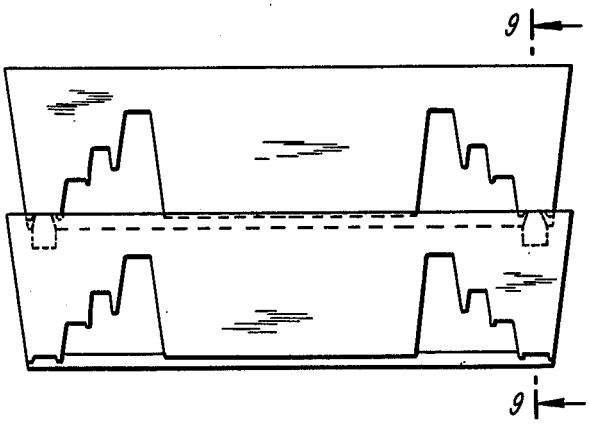
FIG. 20 is a profile view of the end walls of basket assemblies in the full stacking position.
Figure 21:
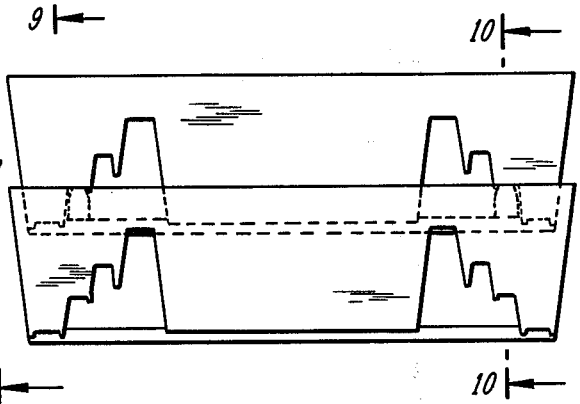
FIG. 21 is a similar profile view of two basket assemblies in the upper nesting position.
Figure 22:
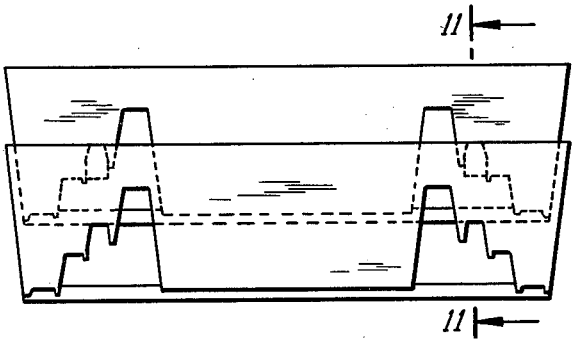
FIG. 22 is a similar profile view of two basket assemblies in the lower nesting position.

The feature of locating the high stacking position projections T adjacent the opposite ends of end walls 16, 16a allows for the greatest stability when a plurality of basket assemblies B are stacked to the maximum height, and accordingly minimizes the chances of tipping of the baskets (see FIG. 20).

Figure 3:
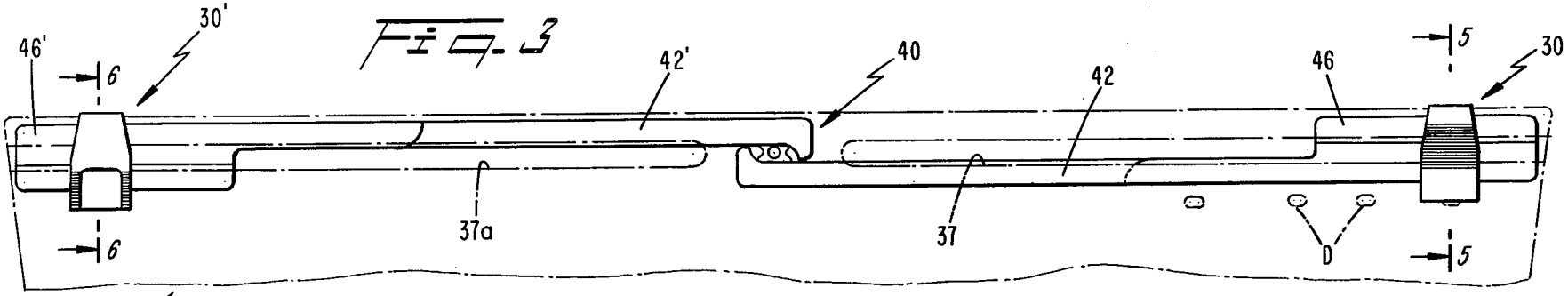
FIG. 3 is an enlarged, detailed view of an inside upper portion of each end wall illustrating the positioning of the stacking lugs at their outermost locations.
Figure 4:
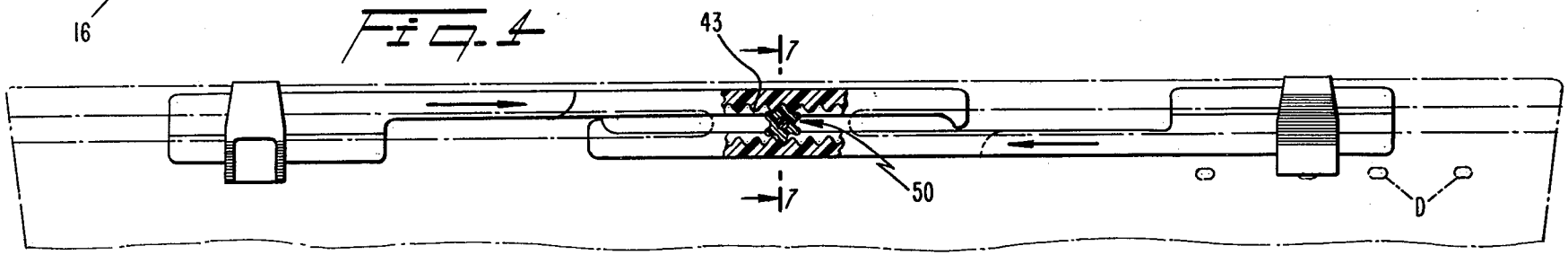
FIG. 4 is a view corresponding to FIG. 3 showing equal and opposite movement of the lugs provided on each end wall with a rack and pinion arrangement carried within each end wall.
Figure 6:
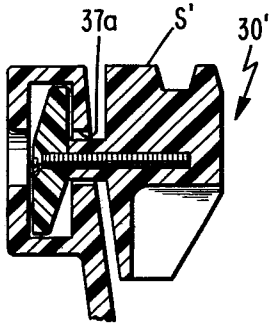
FIG. 6 is a view taken through the line 6—6 of FIG. 3 illustrating the fastening of a slave lug to the rack and pinion arrangement for equal and opposite movement when the master lug is manually indexed along the end wall.
Figure 5:
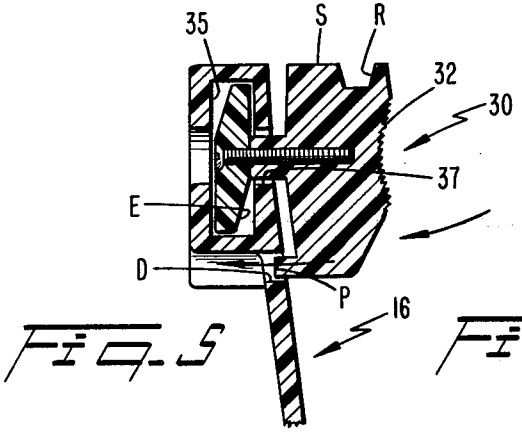
FIG. 5 is a view taken through the line 5—5 of FIG. 3 illustrating the fastening of a master lug to the rack and pinion arrangement for sliding movement along the end wall.

Referring now to FIGS. 3–8, a pair of stacking lugs 30 and 30' are secured to the upper portion of each end wall 16, 16a for corresponding sliding movement along the end walls above stepped towers T1–T3. Each lug 30, 30' projects inwardly from the associated end wall and respectively includes upwardly facing support surfaces S and S', as shown in FIGS. 5 and 6. Lugs 30, 30' are movable into corresponding, vertically aligned locations with either stacking projections T, or stepped towers T1–T3, so as to be engageable with selected stop surfaces N1–N3, in a manner described below. In vertical alignment with the selected stop surfaces, it will be appreciated that the lugs 30, 30' of a lower basket are capable of travel through the selected slots of an upper basket until the support surfaces S, S' enter into supporting engagement with the corresponding positioned stop surfaces of similar height formed in the upper basket.

As best shown in FIGS. 2 and 3, lugs 30, 30' are upwardly tapered to the same degree as each tower slot C1–C3 to enable each lug to move into final supporting engagement with the corresponding stop surfaces as each basket is placed in stacking engagement. This feature assures positive seating of the proper stop surface of the tower with the support surfaces S, S' of the lugs. In other words, if the lugs are not in the exact adjusted position, or if there is slight misalignment between the baskets during stacking, the underneath sides of the tapered flanges 22 provide the necessary guiding action to insure positive seating engagement.

A retaining groove R is provided in each surface S, S'. In high stack position of an upper, nested basket, the grooves R on a lower basket receive stacking projections T of the upper basket to assure positive supporting engagement, as shown in FIG. 9.

Lugs 30, 30' are located at opposite ends of each end wall 16, 16a and are interconnected for simultaneous sliding movement into vertical alignment with selected stepped towers T1, T2 or T3 with the unique arrangement of parts discussed below. To achieve corresponding lug movement, lug 30 in each pair serves as a master lug and includes a scored indentation 32 for thumb engagement. The master lug 30 is interconnected to lug 30' in the pair, hereinafter termed slave lug, with a rack and pinion arrangement 40.

In the preferred embodiment, each rack and pinion control arrangement 40 is carried within a rectangular channel 35 (see FIGS. 5 and 7) provided along the upper portion of each end wall. Each channel 35 extends horizontally the full length of the end walls. A pair of horizontal guide openings 37, 37a are formed along the inwardly directed surface of each channel, as best shown in FIGS. 3 and 5. Openings 37, 37a respectively receive bosses (FIGS. 5 and 6) of lugs 30, 30' for attachment to runners 42, 42' and to allow smooth sliding lug movement along the end walls. The feature of positioning rack and pinion arrangements 40 in the channels protects both the rack and pinion and the runners from damage that can occur during stacking and promotes smooth and reliable lug adjusting movement.

As shown in FIGS. 3 and 4, each rack and pinion control arrangement 40 is actually a part of the lower and upper runners 42, 42' carried within the channel. Thus, the runners 42, 42' have positioning racks 43 formed along one edge. Racks 43 face each other when the runners are inserted into channel 35 through the open channel ends, and are drivingly coupled with an idler pinion 50 positioned in the center of the channels, as discussed more fully below. To index lugs 30, 30' into stacking location above selected nesting surfaces, it is important that the rack length correspond to a distance at least equal to the separation between the outermost stacking projection T and innermost stepped tower T3.

The bosses of the lugs 30, 30' in each pair are respectively mounted to runners 42, 42' through guide openings 37, 37a as mentioned above. As best shown in FIG. 3, the lugs are secured to the outermost end portions of each runner for corresponding sliding movement along the end walls. These outermost ends of the runners serve as lug mounting ends 46, 46' and are dimensioned to achieve a close tolerance fit with the channel walls. This enables each runner to slide smoothly through the channel without wedging against the channel walls and assures equal and opposite sliding lug movement due to driving engagement with pinion 50.

Figure 7:
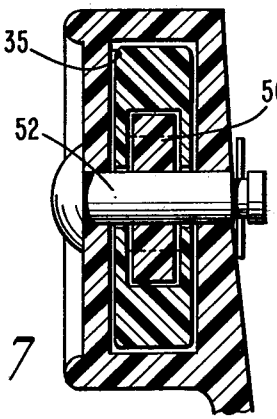
FIG. 7 is a view taken through the line 7—7 of FIG. 4 illustrating the positioning of an idler pinion in the center of a channel formed along the upper edge of each end wall in meshing engagement with the pair of positioning racks on the runners.
Figure 8:
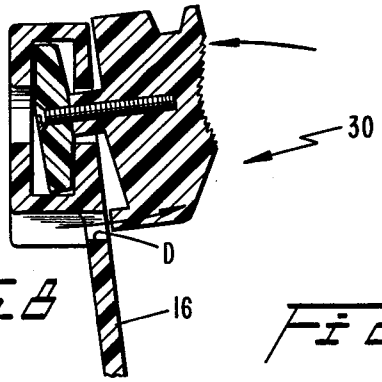
FIG. 8 is a view corresponding to FIG. 5 showing means for locking and unlocking the master lug in position above selected stop surfaces to obtain the desired basket stacking height.

To achieve the equal and opposite driving engagement between idler pinion 50 and runners 42, 42', the pinion is retained within channel 35 on an axle pin 52, as best shown in FIG. 7.

With the feature of the rack and pinion control arrangement 40, thumb engagement with master lug 30 assures that slave lug 30' follows the movement of the master lug. In this way the two lugs simultaneously engage corresponding stop surfaces of the stepped towers or stacking projections.

To insure positive alignment with the selected surfaces, detent openings D are provided on the end walls 16, 16a in vertical alignment above the nesting surfaces engageable with the master lug (see FIG. 3). A locking pin P projects outwardly from the master lugs 30 to engage the corresponding opening D when the lug is properly positioned in alignment with the selected surfaces. This assures positive locking action for greater stability in the stack.

To unlock master lugs 30 from openings D for lug resetting movement along the end walls, diagonally opposed edges E of lug mounting ends 46 of the runners 42 are obliquely formed, as shown in FIG. 5. Upward rotation of lugs 30 is thereby allowed (see arrows in FIG. 8), with the torsional action of the runner ends 46. This action permits resetting of both the master and interconnected slave lugs into vertical alignment with the selected stacking tower. The spring action due to the torsion bar effect returns the lock pin P to the opening D as the thumb releases the master lug assuring automatic proper lug positioning (see arrows in FIG. 5).

The advantages provided with the basket assembly B of the invention can best be understood by following the operations necessary to achieve the various nesting and stack positions. In high stack relationship, as illustrated by FIGS. 9 and 20, the lower basket B serves as a bread basket or a basket for high profile bakery products. This requires nesting of an upper basket B' at a minimal depth in the lower basket B to obtain maximum storage height in the lower basket. Accordingly, stacking projections T and the positioning of lugs 30, 30' on end walls 16, **16*a* are dimensioned to provide approximately five and one-eighth inches clearance between the upper surface of bottom wall 12** of lower basket B and the lower surface of the bottom wall of the upper, nested basket.

To achieve high stack position, the master lugs 30 of the lower basket are manually indexed by thumb engagement to their outermost locations along the end walls. Thus lug movement can be easily accomplished by bakery loaders while moving the basket to the stacking location. Obviously, in view of the equal and opposite sliding movement obtained with rack and pinion arrangement 40, the slave lugs 30' also slide to their outermost locations in vertical alignment with stacking projections T. The lock pins P provided on the master lugs will automatically engage the detent openings D when the lugs are released, due to the torsional characteristics of runner 42, to fixedly lock the lugs into high stack position.

As best shown in FIG. 1, a positioning arrow can be imprinted on support surfaces S of the master lugs 30; likewise, the word "BREAD" can be imprinted on the upper edge of end walls 16, **16*a*** in vertical alignment with stacking projections T, to visually enable proper setting of the basket to receive bread and other high profile products.

After proper setting of lugs 30, 30' into high stack position, a like basket assembly B' is simply lowered onto the lower basket B in vertical in-line nesting relationship. Because of the like construction of the baskets, the downwardly extending stacking projections T provided in the upper basket register with upwardly facing surfaces S, S' provided on the lugs of the lower basket. As the projections T contact surfaces S, S', these projections engage retaining grooves R (see FIG. 9) to provide a stable, high stack position of the upper basket. By locating projections T at the outermost ends of walls 16, **16*a*** maximum stability and prevention against tipping is assured.

Upper and lower intermediate nesting positions of baskets B, B' are shown respectively in FIGS. 10 and 21 and FIGS. 11 and 22. In the upper nesting position, the lower basket B serves as a bun tray. Accordingly, nesting surfaces N1 in stepped towers T1 are spaced upwardly from bottom wall 12 to provide approximately three and five-eighth inches clearance between the bottom walls of upper and lower baskets B, B' in this nesting position.

To achieve the upper nesting position, master lugs 30 of lower basket B are moved along the end walls until the positioning arrow printed on the lugs is adjacent the word "BUN" printed on the upper edge of the end walls 16, **16*a*. Of course, slave lugs 30' slide automatically into corresponding location along the opposite ends of walls 16, 16*a***, as described above. Lock pins P engage openings D to prevent the lugs from inadvertently travelling out of alignment.

The basket assembly B' is then simply lowered onto the basket B with the preset lugs in vertical in-line nesting relationship. Because of the basket construction, the nesting surfaces N1 provided in the upper basket are in vertical alignment and in register with upper support surfaces S, S' of the lower basket lugs. As the upper basket is lowered onto the lower basket, the lugs 30, 30' of the lower basket engage and travel smoothly through the tower slots C1 of the upper basket, under the guiding action of tapered flanges 22, if necessary, until support surfaces S, S' enter into supporting engagement with surfaces N1. The corresponding taper of the lugs and tower slots assures positive seating to promote stack stability.

In the lower intermediate nesting position, lower basket B serves as a cake tray, requiring less stacking clearance height than required for the upper nesting position, described above. Accordingly, nesting surfaces N2 are spaced upwardly from bottom wall 12 to provide approximately two and seven-eighths inches clearance between the bottom walls of upper and lower baskets B, B' in nesting engagement.

The lower nesting position is achieved in the same manner described above for the upper nesting position. The word "CAKE" printed on the upper edge of the end walls (see FIG. 1) is vertically aligned with surfaces N2 to insure proper visual location of the master lugs 30 adjacent thereto. If necessary the lugs 30, 30' are guided into the final position along the tower slot C2, as before.

Figure 23:
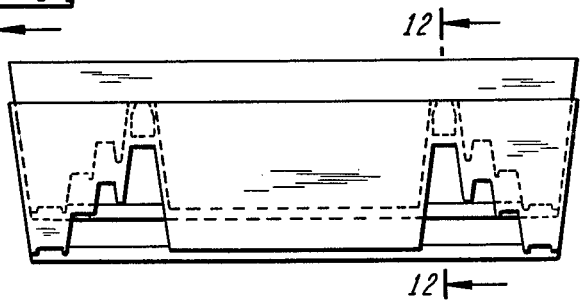
FIG. 23 is a similar profile view of two basket assemblies in full nesting engagement.

The full nesting position (i.e. minimal stacking position) between upper and lower baskets B, B' is illustrated in FIGS. 12 and 23. Such position is obtained by sliding master lugs 30 of the lower basket to their innermost travel locations, in alignment with the word "NESTING" printed on the upper edge of the end walls. Upper basket B' is placed upon the lower basket, in the manner described above, until surfaces N3 of the upper basket contact surfaces S, S' of the lower basket in supporting engagement. Again, if necessary, the lugs are guided along slots C3 as the baskets nest together. In the full nest position, less air space is shipped, thereby allowing more empty baskets to be economically shipped.

In view of the foregoing description of the preferred embodiment, it will now be apparent that numerous advantages are derived from use of the basket assembly of the present invention, in addition to those advantages set forth above. Of paramount importance, the feature of blind stacking is advantageously achieved since the baskets B, B' do not have to be rotated one hundred eighty degrees, that is reversed, to obtain different stacking heights. The stacker does not have to observe the previous basket since the lugs have been previously properly set for the goods in that particular basket. Each basket can receive the next basket regardless of the end-to-end rotation. In other words, simple manual sliding movement of master lugs 30 to their desired locations on the end walls of each basket for the product in that basket is all that is necessary to enable the baskets to be successively stacked irrespective of orientation. This assures the least amount of movement and the least chance for mistake allowing bakery loaders to achieve rapid stacking operations. Of course, the feature of blind stacking obtained with the present invention is of particular importance in cases where bakery loaders have to stack over their heads and thus the inside of the top basket cannot be seen in order to tell in what direction the basket is turned (e.g. when stacking ten to twelve baskets at full stack height).

In accordance with the above features, the baskets are capable of interfitting together with the blind stacking capability to achieve vertical in-line nesting at four stacking heights (nesting depths). These features have previously been unattainable with prior art reversing baskets. In addition, the features of basket B also allow for intermixing of baskets in various stack positions, since all that is required is easy lug movement of a lower basket B for the produce in that basket to preset the nesting depth of an upper basket B'.

Figure 18:
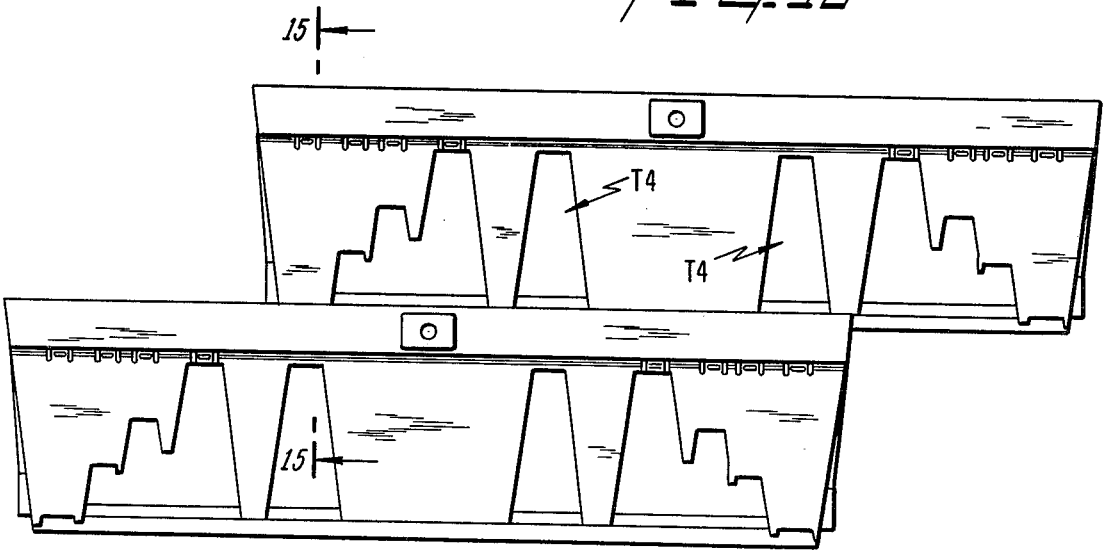
FIG. 18 is a side view of the baskets shown in FIG. 17 to illustrate the offset displacement of basket assemblies at full stacking height in display arrangement.
Figure 19:
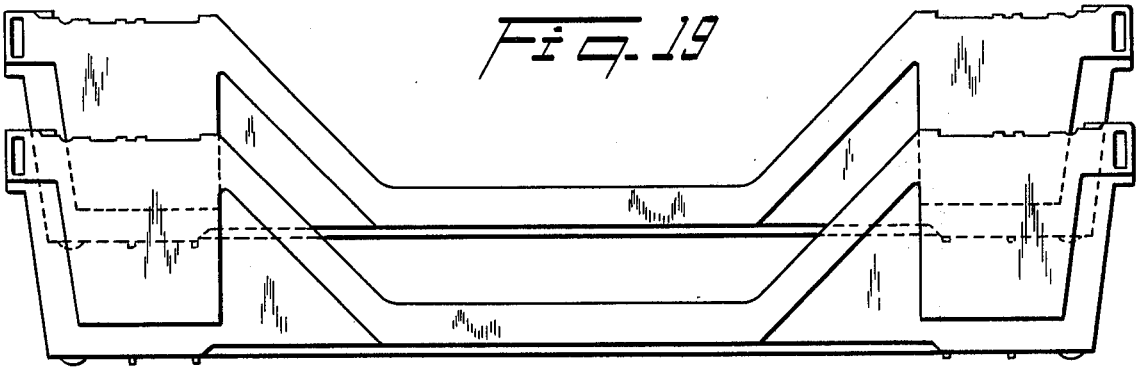
FIG. 19 is a profile view of the side walls of basket assemblies positioned in the lower nesting position.

For the purpose of achieving vertical offset stacking, such as for display purposes at the point of purchase of the bakery product, a pair of identical vertical stacking towers T4 are provided on each end wall 16 and 16*a*. As shown in FIGS. 2, 16 and 18, towers T4 are similar in construction to stepped towers T1–T3 and extend upwardly from bottom wall 12 to the upper edge of the end walls (see FIG. 15).

Figure 15:
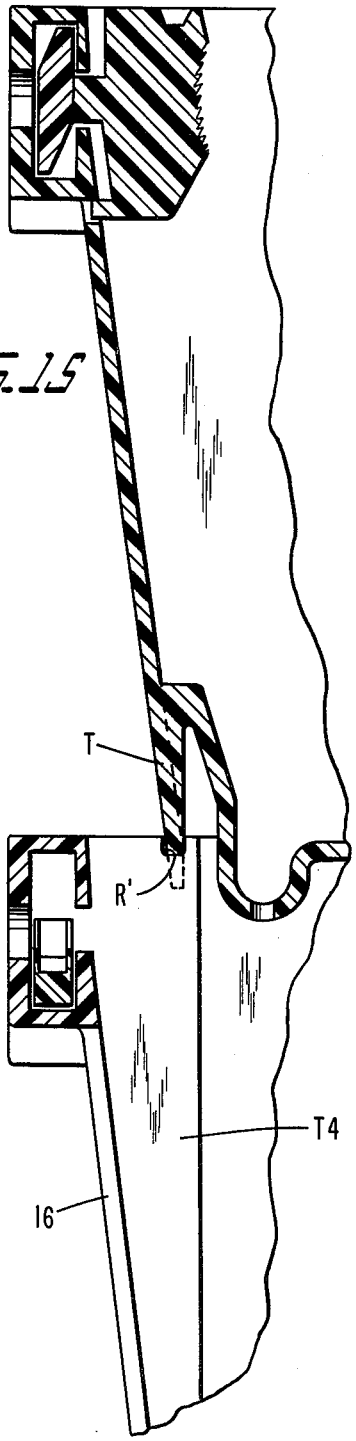
FIG. 15 is a view taken through the line 15—15 of FIG. 18 showing engagement between two basket assemblies to achieve vertical offset stacking relationship.
Figure 17:
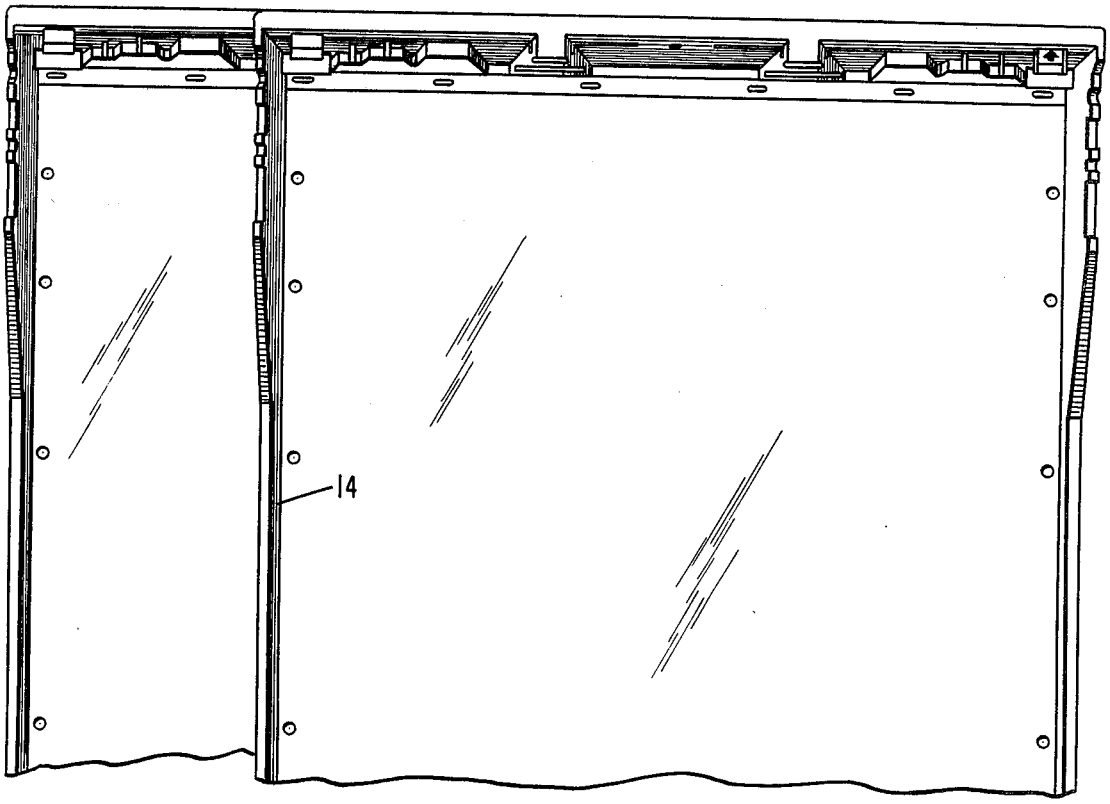
FIG. 17 is a partial, top plan view of two like basket assemblies in vertically offset stacking relationship.

Towers T4 are located inwardly adjacent stepped towers T3 and in equispaced relationship with the center of the basket. A retaining groove R' (FIGS. 15 and 16) is formed in the upper surface of towers T4 for receiving the downwardly extending stacking projections T of an upper basket for vertical offset stacking relationship, as shown in FIGS. 15, 17 and 18.

Figure 13:
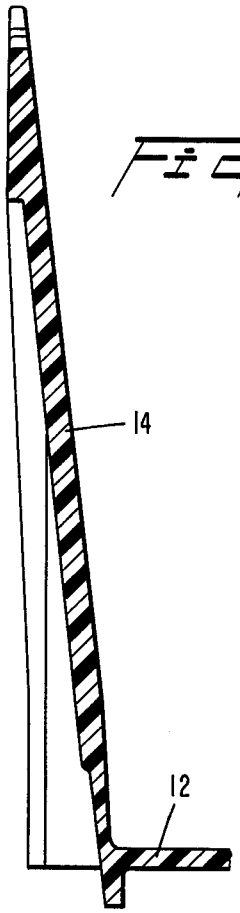
FIG. 13 is a view taken through the line 13—13 of FIG. 1 showing the construction of the basket side wall adjacent the ends.
Figure 14:
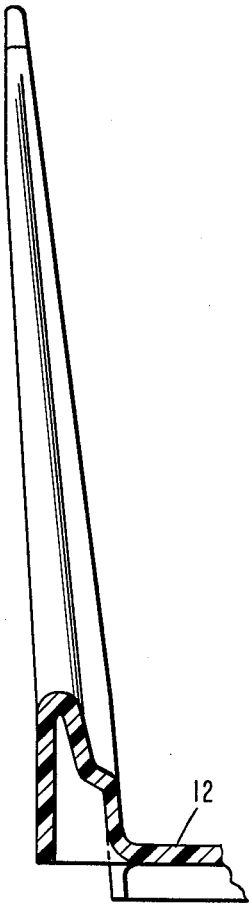
FIG. 14 is a view taken through the line 14—14 of FIG. 1 showing the construction of the center of each side wall.

With these display stacking features, a plurality of like basket assemblies B can be stacked in a pyramidal display pattern, by placing the like baskets so that side walls 14 are adjacent and parallel to each other. Additional baskets are then stacked on top of the lower baskets, in overlapping relationship (as viewed from the end walls), so that the projections T of the upper basket engage the pair of retaining slots R' on each of adjacent lower basekts, for balanced and positive display stacking. As shown in FIGS. 1, 13 and 14, the center portions of side walls 14 and 14*a* are of reduced height to better enable viewing of the basket contents when the baskets are in display pattern.

The basket assemblies of the invention, including rack and pinion arrangement 40 and lugs 30, 30' can be fabricated in any suitable manner and from any suitable material. Preferably, lightweight and durable plastic materials are used, such as high density polyethylene, polystyrene or the like. A preferred method for forming basket bodies 10 includes known injection molding techniques.

While the baskets of the present invention have been described to achieve four different stacking heights, including two intermediate nesting positions, it will be further appreciated that additional intermediate positions can be achieved by providing additional stepped towers in the end walls in appropriate spaced relationship.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

1. A nestable and stackable basket assembly enabling a plurality of like basket assemblies to nest within each other at adjustable heights in stacked relationship, comprising:

(a) a bottom wall, end walls and side walls forming an upwardly open basket body;

(b) stacking tower means including stepped slot means located in each end wall and projecting from said end walls to provide nesting stop surfaces located at different and corresponding heights;

(c) lug means supported on and projecting from the upper portion of each of the end walls, each of said lug means having an upwardly projecting support surface, said lug means being laterally and slidably movable along the end walls such that the support surfaces of the lug means can be vertically aligned for supporting engagement with the corresponding stop surfaces of like basket assemblies, whereby multiple nested and stacked positions of said basket assemblies may be obtained.

2. A basket assembly according to claim 1, further comprising control means located on the end walls for controlling sliding movement of the lug means.

3. A basket assembly according to claim 2, wherein said stacking towers are inwardly directed recesses in the end walls.

4. A basket assembly according to claim 3, wherein each tower includes an upper step defining one of the stop surfaces.

5. A basket assembly according to claim 4, wherein said tower slot means has an upper end defining the corresponding stop surface, whereby the tower slot means guides the support surfaces of a basket assembly into supporting engagement with corresponding stop surfaces of an upper basket assembly to achieve adjustable stacked positions.

6. A basket assembly according to claim 5, wherein each tower slot means is substantially vertical.

7. A basket assembly according to claim 1, wherein said lug means includes a pair of lugs provided on each end wall, said support surfaces being upwardly directed and said lugs project inwardly from the end walls to thereby locate said support surfaces in alignment with selected stop surfaces.

8. A basket assembly according to claim 2, wherein said control means includes a pair of channels, each channel forming an upper portion of each end wall, and means for securing the lug means to the channels in sliding engagement therewith.

9. A basket assembly according to claim 8, wherein each channel includes a pair of inwardly facing guide openings extending substantially horizontally above said tower slots, said lug means including a pair of lugs, and said securing means including a boss projecting into the guide openings to secure the lugs to the channels to thereby selectively position the support surfaces in substantially vertical alignment with the selected nesting stop surface.

10. A basket assembly according to claim 9, wherein said control means further includes a rack and pinion control arrangement carried on each end wall to enable equal and opposite movement of said lugs, one of said lugs being a slave lug and the other lug being a master lug located on the same end wall, the master lug being manually indexed along said end wall, said lugs being operatively connected to said control arrangement.

11. A basket assembly according to claim 10, wherein each rack and pinion control arrangement includes an idler pinion and upper and lower runners having positioning racks, said pinion and runners being operatively arranged within the channel for moving the master lug and slave lug into alignment with the selected stop surfaces.

12. A basket assembly according to claim 9, wherein said boss projects outwardly from each lug to secure each lug to the respective runner.

13. A basket assembly according to claim 10, further comprising a plurality of detent openings formed on the end walls above the stop surfaces, and a lock pin formed on the master lugs, whereby said lock pin engages one of said openings when said lug is in position above a selected stop surface.

14. A basket assembly according to claim 13, wherein said runner attached to the master lug includes diagonally opposed oblique edges to thereby enable the master lug to pivot into and out of locking engagement with the detent openings.

15. A basket assembly according to claim 11 or 14, wherein said lugs and sides of the tower slots are tapered to the same degree to thereby enable the tapered sides of the slots to guide the lugs into positive supporting engagement with the stop surfaces.

16. A basket assembly according to claim 1, wherein is provided additional stop surfaces including downwardly directed stacking projections extending below the bottom wall to define a high stack position when said stacking projections of an upper basket are positioned on the support surfaces of a lower basket.

17. A basket assembly according to claim 16, wherein each stacking projection is located at an outermost end of the end wall means to promote stability of the stack.

18. A basket assembly according to claim 17, further comprising a retaining groove formed in each of said support surfaces, said retaining groove receiving the stacking projections of an upper nested basket in positive stacking relationship.

19. A basket assembly according to claim 1, wherein said stepped tower means includes multiple towers of progressively increasing height in a direction away from the side walls.

20. A basket assembly according to claim 1, further comprising display stacking tower means formed on each end wall, said display tower means including support surface means including a retaining groove to thereby receive the stacking projections of an upper basket in vertically offset stacking relationship.

21. A basket assembly according to claim 20, wherein said display stacking tower means project upwardly from the bottom wall means to a height substantially equal to the height of said end walls.

* * * * *